US011776469B2

(12) United States Patent
Yang

(10) Patent No.: US 11,776,469 B2
(45) Date of Patent: Oct. 3, 2023

(54) DISPLAY APPARATUS AND ELECTRONIC DEVICE

(71) Applicant: GUANGDONG OPPO MOBILE TELECOMMUNICATIONS CORP., LTD., Dongguan (CN)

(72) Inventor: Xin Yang, Dongguan (CN)

(73) Assignee: GUANGDONG OPPO MOBILE TELECOMMUNICATIONS CORP., LTD., Dongguan (CN)

( * ) Notice: Subject to any disclaimer, the term of this patent is extended or adjusted under 35 U.S.C. 154(b) by 0 days.

(21) Appl. No.: 17/685,887

(22) Filed: Mar. 3, 2022

(65) Prior Publication Data

US 2022/0189394 A1 Jun. 16, 2022

Related U.S. Application Data

(63) Continuation of application No. PCT/CN2019/114573, filed on Oct. 31, 2019.

(51) Int. Cl.

| | |
|---|---|
| ***G09G 3/30*** | (2006.01) |
| ***G09G 3/3225*** | (2016.01) |
| ***G09G 3/20*** | (2006.01) |

(52) U.S. Cl.

CPC ..... *G09G 3/3225* (2013.01); *G09G 3/2003* (2013.01); *G09G 2300/0408* (2013.01)

(58) Field of Classification Search

CPC ..... G09G 3/3225; G09G 3/2003; G09G 2300/0408; G09G 3/3208; G09G 3/3258; G09G 2310/0281; G09G 2300/0804; G09G 2300/0452; G09G 2310/0221; G09G 2310/0278; G09G 2300/0426; H10K 59/13; H10K 59/40; H10K 59/131

USPC ..... 345/76

See application file for complete search history.

(56) References Cited

U.S. PATENT DOCUMENTS

| | | | | |
|---|---|---|---|---|
| 2016/0132713 | A1 | 5/2016 | Bae et al. | |
| 2017/0364188 | A1 | 12/2017 | Bae et al. | |
| 2020/0052048 | A1* | 2/2020 | Kuo | H10K 59/65 |
| 2020/0212357 | A1* | 7/2020 | Lim | H10K 77/10 |

(Continued)

FOREIGN PATENT DOCUMENTS

| | | |
|---|---|---|
| CN | 207264695 U | 4/2018 |
| CN | 108376696 A | 8/2018 |

(Continued)

OTHER PUBLICATIONS

International Search Report and the Written Opinion dated Jul. 24, 2020 From the International Searching Authority Re. Application No. PCT/CN2019/114573.

(Continued)

*Primary Examiner* — Jennifer T Nguyen

(74) *Attorney, Agent, or Firm* — Quarles & Brady LLP

(57) ABSTRACT

Embodiments of the present application provide a display apparatus and an electronic device. The display apparatus includes a first display area, a first driving unit, a second display area, and a second driving unit. Each first driving unit in the first display area drives a first pixel, each second driving unit drives one or more second pixels of the second display area, a plurality of second driving units are provided in the first display area, and the number of thin film transistors included in one second driving unit is less than that in one first driving unit.

18 Claims, 19 Drawing Sheets

(56) References Cited

U.S. PATENT DOCUMENTS

| | | | | |
|---|---|---|---|---|
| 2020/0411610 | A1* | 12/2020 | Zhang | H10K 71/00 |
| 2021/0090501 | A1* | 3/2021 | Wu | H10K 59/131 |
| 2021/0265430 | A1* | 8/2021 | Chang | H10K 59/353 |

FOREIGN PATENT DOCUMENTS

| | | | |
|---|---|---|---|
| CN | 108389879 | A | 8/2018 |
| CN | 108983872 | A | 12/2018 |
| CN | 208607570 | U | 3/2019 |
| CN | 110189639 | A | 8/2019 |
| CN | 110189706 | A | 8/2019 |
| CN | 110232892 | A | 9/2019 |
| CN | 110278300 | A | 9/2019 |
| EP | 3176772 | | 6/2017 |

OTHER PUBLICATIONS

The supplementary European search report dated Aug. 9, 2022 from European patent Application No. 19951026.4.
The First Office Action dated Apr. 21, 2023 from Chinese patent application No. 201980098045.8.

* cited by examiner

DISPLAY APPARATUS AND ELECTRONIC DEVICE

CROSS REFERENCE TO RELATED APPLICATIONS

This application is a continuation of International Application No. PCT/CN2019/114573, filed Oct. 31, 2019, the contents of which are incorporated herein by reference in their entirety.

BACKGROUND

The present disclosure relates to the field of electronic technology, and more particular, to a display apparatus and an electronic device.

With developments of communication technology, electronic devices such as smart phones are becoming more and more popular. During uses of the electronic device, the electronic device can use its display screen to display images.

In order to have better display effects and user experiences, the size of a display screen is getting larger and larger, but it is difficult to hold the display screen of an electronic device when it exceeds a certain size, so it is more and more important to increase a screen-to-body ratio of the display screen. In the related art, a camera is set on the backside of the display of the display apparatus, and the display apparatus is provided with a light transmission channel corresponding to the camera. The camera is used to form images by obtaining external light signals through the light transmission channel. The light transmission channel is small in size and can increase the screen-to-body ratio of the display apparatus. However, the light transmission channel cannot display images, which makes a display area of the display apparatus incomplete.

SUMMARY

The embodiments of the present application provide a display apparatus and an electronic device, which can increase a screen-to-body ratio of the display apparatus and make a display area of the display apparatus complete.

An embodiment of the present application provides a display apparatus, comprising a first display area, a first driving unit, a second display area, and a second driving unit.

The first display area comprises a plurality of first pixels, the plurality of first driving units arranged in the first display area, and each of the first driving units is electrically connected to the first pixel to drive the first pixel.

The second display area is adjacent to the first display area, the second display area comprises a plurality of second pixels, and the plurality of second driving units arranged in the first display area. Each of the second driving units is electrically connected to one or more of the second pixels to drive the one or more of the second pixels, and the number of thin film transistors included in one second driving unit is smaller than the number of thin film transistors included in one first driving unit.

An embodiment of the present application also provides an electronic device comprising a display apparatus and a camera, wherein the display apparatus is the above-mentioned display apparatus. The camera comprises a lens that is disposed toward the second display area. The camera is used to form images by obtaining external light signals passing through the second display area.

BRIEF DESCRIPTION OF THE DRAWINGS

In order to more clearly describe technical solutions in the embodiments of the present application, the following will briefly introduce the drawings that need to be used in the description of the embodiments.

DETAILED DESCRIPTION OF THE ILLUSTRATED EMBODIMENTS

Figure 1:
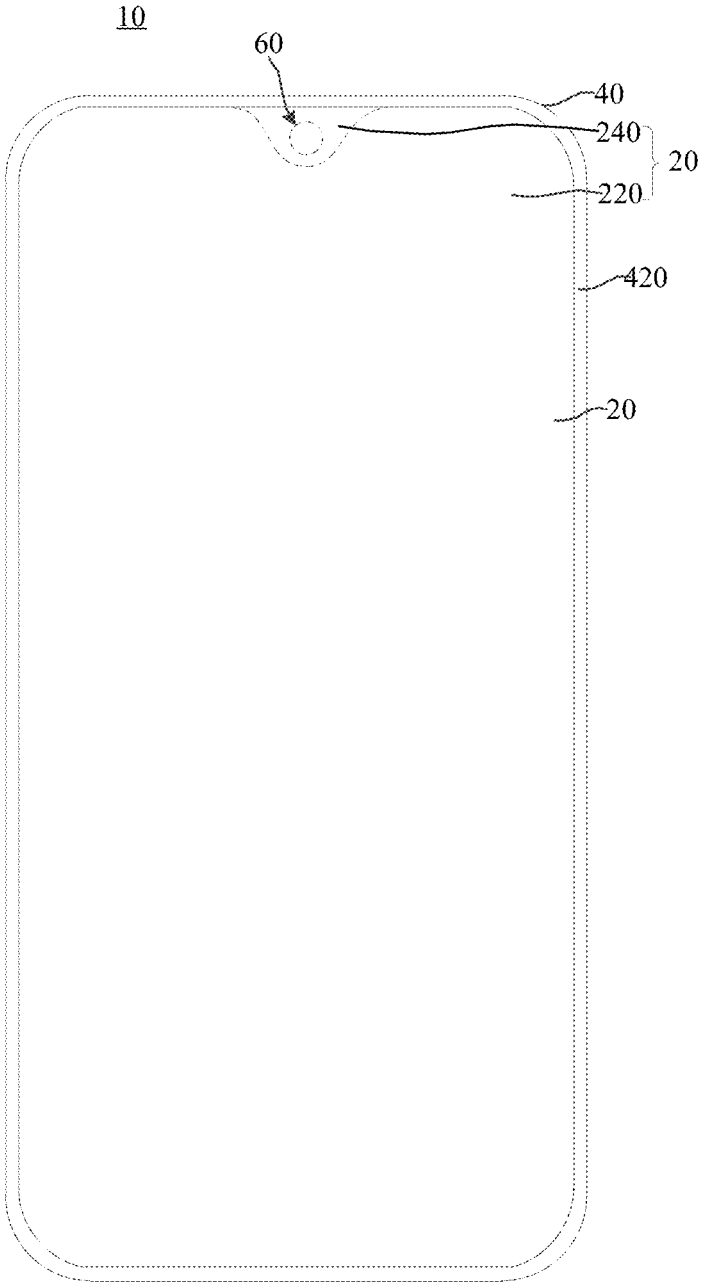
FIG. 1 is a first schematic structural diagram of an electronic device provided by an embodiment of the application.

The embodiments of the present application provide an electronic device and a display apparatus thereof. The electronic device may include a display apparatus and a camera.

The lens of the camera is set relative to the display apparatus, that is, the camera forms images by obtaining external light signals passing through the display apparatus. It can be understood that the light transmittance of conventional display apparatus is low, and the imaging effect of the camera through the display apparatus is not good. For this reason, the embodiment of the present application may divide the display apparatus into a plurality of areas, for example, setting the light transmittance of a portion of the display apparatus corresponding to the camera to be greater than the light transmittance of other positions of the display apparatus, which can improve the imaging effect of the camera. Technical solutions in the embodiments of the present application will be clearly and completely described below in conjunction with the drawings in the embodiments of the present application.

Electronic devices provided by embodiments of the application can be mobile terminal devices such as mobile phones and tablet computers, and can also be gaming devices, augmented reality (AR) devices, virtual reality (VR) devices, on-board computers, laptop computers, data storage apparatus, audio player, video player, wearable devices and other devices with display apparatus, wherein the wearable devices can be smart bracelets, smart glasses, etc.

An embodiment of the present application provides a display apparatus, comprising a first display area, a first driving unit, a second display area, and a second driving unit.

The first display area comprising a plurality of first pixels, the plurality of first driving units arranged in the first display area, and each of the first driving units is electrically connected to the first pixel to drive the first pixel.

The second display area is adjacent to the first display area, the second display area comprises a plurality of second pixels, the plurality of second driving units arranged in the first display area, each of the second driving units is electrically connected to one or more of the second pixels to drive the one or more of the second pixels, and the number of thin film transistors included in one second driving unit is smaller than the number of thin film transistors included in one first driving unit.

The second display area comprises a plurality of first pixel sets, each of the first pixel sets comprises a plurality of the second pixels connected in parallel, and one second driving unit is electrically connected to all the second pixels connected in parallel in one first pixel set.

The first pixel set comprises a plurality of the second pixels of different colors or the first pixel set comprises a plurality of the second pixels of the same color.

The second display area comprises a plurality of pixel units, and each of the pixel units comprises at least three second pixels of different colors.

A second pixel in one of the pixel units is connected in parallel with a second pixel in at least one of the other pixel units, and the at least two second pixels connected in parallel form the first pixel set.

The second pixels of the same color in the at least two pixel units are connected in parallel, and the at least two second pixels of the same color connected in parallel form the first pixel set.

The second display area comprises a plurality of pixel units, and each of the pixel units comprises at least three second pixels of different colors, at least two second pixels of different colors in the pixel unit are connected in parallel, and the at least two second pixels of different colors connected in parallel form the first pixel set.

The first driving unit is 7T1C or 5T1C, and the second driving unit is 2T1C.

The display apparatus further comprises a third display area, the third display area being connected to the second display area via the first display area, the first display area comprises a plurality of second pixel sets, each of the second pixel sets comprises at least two first pixels connected in parallel, a plurality of the first pixels connected in parallel in one second pixel set are electrically connected to one first driving unit, the third display area comprises a plurality of third pixels and a plurality of third driving units, and each of the third driving units is electrically connected to one of the third pixels.

The second pixel set comprises a plurality of the first pixels of different colors, or the second pixel set comprises a plurality of the first pixels of the same color.

One of the second pixel sets is arranged corresponding to one of the first driving units and at least one of the second driving units.

One of the first pixels in the second pixel set is arranged corresponding to one of the first driving units, and another one of the first pixels is arranged corresponding to one of the second driving units.

The display apparatus further comprises a driving chip and a plurality of driving signal lines, the driving chip controlling the first driving unit and the second driving unit through the plurality of driving signal lines, wherein at least one of the driving signal lines is electrically connected to the first driving unit and the second driving unit.

A distribution density of the second pixels is smaller than a distribution density of the first pixels.

An embodiment of the present application further provides an electronic device comprising the display apparatus described above and a camera.

The second display area comprises a plurality of first pixel sets, each of the first pixel sets comprises a plurality of the second pixels connected in parallel, and one second driving unit is electrically connected to all the second pixels connected in parallel in one first pixel set.

The second display area comprises a plurality of pixel units, each of the pixel units comprises at least three second pixels of different colors, a second pixel in one of the pixel units is connected in parallel with a second pixel in at least one of the other pixel units, and the at least two second pixels connected in parallel form the first pixel set.

The second pixels of the same color in the at least two pixel units are connected in parallel, and the at least two second pixels of the same color connected in parallel form the first pixel set.

The display apparatus further comprises a third display area, and the third display area is connected to the second display area via the first display area, the first display area comprises a plurality of second pixel sets, each of the second pixel sets comprises at least two first pixels connected in parallel, a plurality of the first pixels connected in parallel in one second pixel set are electrically connected to one first driving unit, and the third display area comprises a plurality of third pixels and a plurality of third driving units, and each of the third driving units is electrically connected to one of the third pixels.

The display apparatus further comprises a substrate, a driving unit layer, and a light-emitting layer, wherein the driving unit layer is disposed on the substrate, and the light-emitting layer is disposed on the driving unit layer.

The substrate is disposed between the camera and the light-emitting layer, wherein the substrate has a first mounting hole facing the second display area, and the camera lens is at least partially located in the first mounting hole.

The drive unit layer has a second mounting hole facing the camera lens, wherein the second mounting hole communicates with the first mounting hole, and the camera lens is at least partially located in the second mounting hole.

Please refer to FIG. 1, which is a first schematic structural diagram of an electronic device provided by an embodiment of the present application. FIG. 1 shows an example in which the electronic device is a mobile phone, wherein the display apparatus 20 comprises a first display area 220 and a second display area 240, and a light transmittance of the first display area 220 is greater than a light transmittance of the second display area 240. The electronic device 10 is provided with a camera 60, a lens of the camera 60 is set toward the second display area 240, and the camera 60 is used to form images by obtaining external light signals passing through the second display area 240. It can also be understood that the camera 60 is disposed under the second display area 240 of the display apparatus 20, and the camera 60 is used to obtain external light signals passing through the second display area 240 of the display apparatus 20, and to form images according to the obtained external light signals. A side of the display apparatus 20 facing the outside can be substantially a display surface, that is, the display surface of the first display area 220 and the display surface of the second display area 240 can occupy the entire front of the display apparatus, or it can be understood that the electronic device 10 is a full-screen device, and the display area of the display apparatus 20 is complete, which increases a screen-to-body ratio of the display apparatus 20. The camera 60 can be used as a front camera of an electronic device, and the camera 60 can be used to obtain images such as a user's selfies through the second display area 240 of the display apparatus 20.

For better understanding of the display apparatus in the embodiment of the present application, the display apparatus will be described in detail below.

Figure 2:
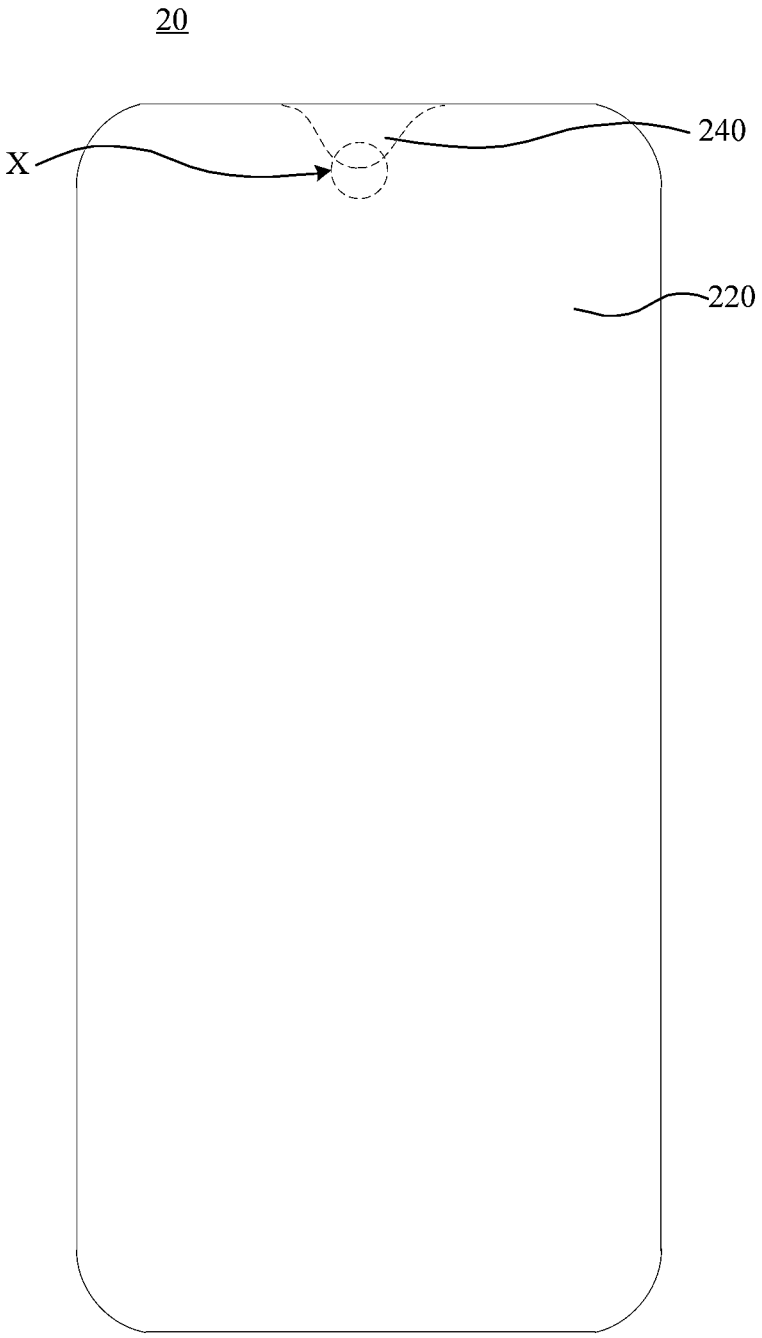
FIG. 2 is a first schematic structural diagram of a display apparatus provided by an embodiment of the application.

Please refer to FIG. 2, which is a first schematic structural diagram of a display apparatus provided by an embodiment of the application. The display apparatus 20 in the embodiment of the present application may comprise a first display area 220 and a second display area 240 that are adjacent to each other. Both the first display area 220 and the second display area 240 can be used to display text or images, and the first display area 220 and the second display area 240 can display the same image together. For example, the first display area 220 displays a portion of a preset image, and the second display area 240 displays the remaining portion of the preset image. The first display area 220 and the second display area 240 may also display different images. For example, the first display area 220 displays a preset image, and the second display area 240 displays an image of a task bar. Both the first display area 220 and the second display area 240 can display contents, the display area is complete, and the screen-to-body ratio of the display apparatus 20 is high. The first display area 220 may be arranged around the second display area 240, and a periphery of the second display area 240 may be adjacent to the first display area 220, that is, the second display area 240 is located in the middle of the first display area 220. The first display area 220 may also partially surround the second display area 240, and a portion of an edge of the second display area 240 is adjacent to the first display area 220. For example, the second display area 240 is located at a corner of the display apparatus 20 or is located in the middle of the top of the display apparatus 20.

Figure 3:
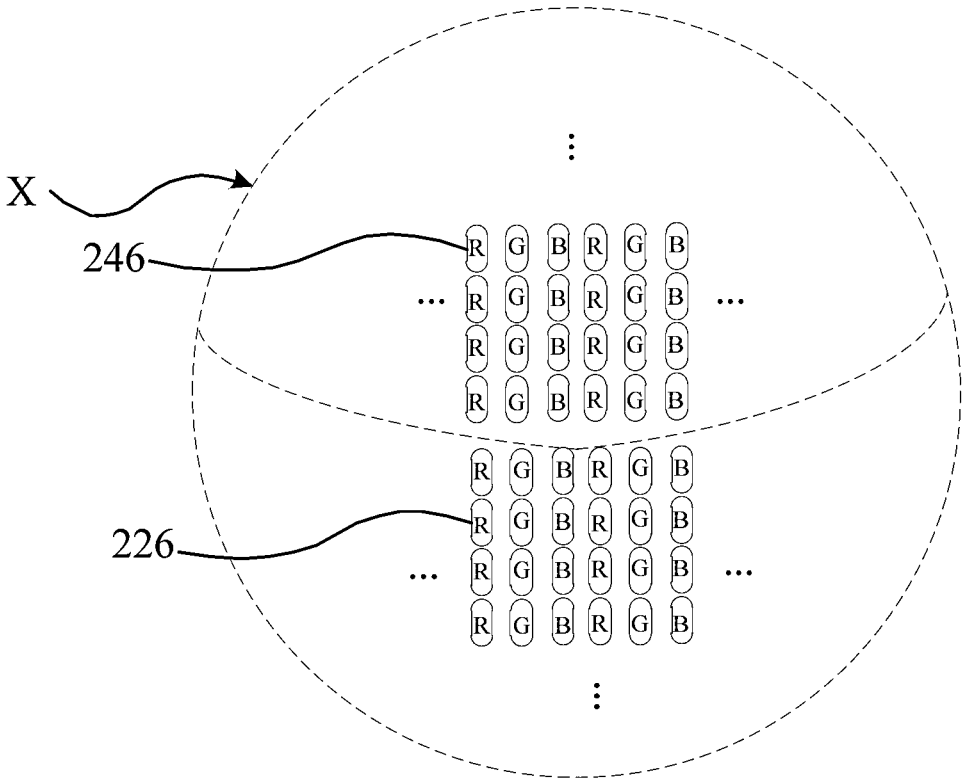
FIG. 3 is a schematic structural diagram of a pixel in a portion X of the display apparatus in FIG. 2.
Figure 4:
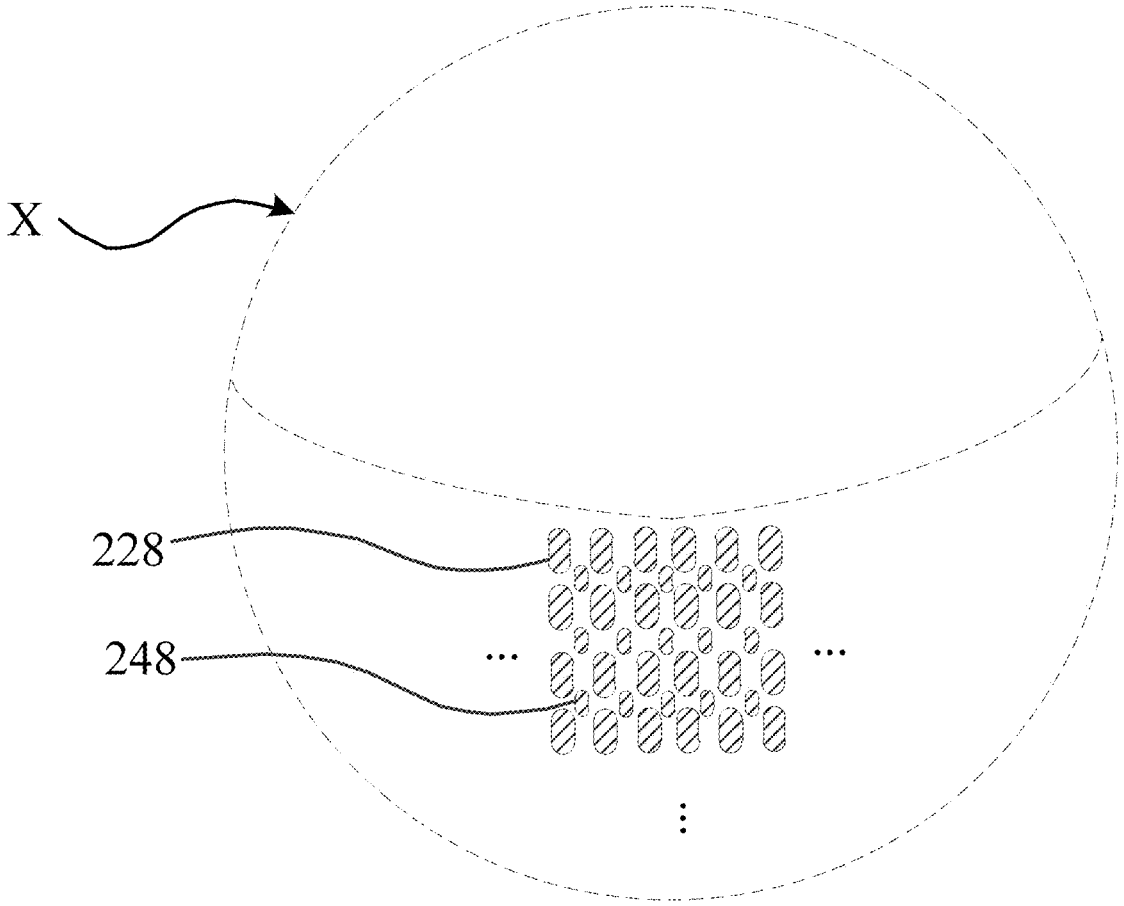
FIG. 4 is a schematic structural diagram of a driving unit in the portion X of the display apparatus in FIG. 2.

Please refer to FIG. 3 and FIG. 4, wherein FIG. 3 is a schematic structural diagram of a pixel in the X portion of the display apparatus in FIG. 2, and FIG. 4 is a schematic structural diagram of a drive unit in the X portion of the display apparatus in FIG. 2. The first display area 220 comprises a plurality of first pixels 226, and the second display area 240 comprises a plurality of second pixels 246. The display apparatus further comprises a plurality of first driving units 228 and a plurality of second driving units 248, and the plurality of first driving units 228 are electrically connected to the plurality of first pixels 226 and are used to drive the plurality of first pixels 226. Specifically, each first driving unit 228 may be electrically connected to one or more first pixels 226 to drive the first pixel 226. The plurality of second driving units 248 are electrically connected to the plurality of second pixels 246 and are used to drive the plurality of second pixels 246. Specifically, each second driving unit 248 may be electrically connected to one or more second pixels 246 to drive one or more second pixels 246. Herein, the first driving unit 228 is disposed in the first display area 220 and is disposed corresponding to the second pixel 246. For example, each first driving unit 228 is electrically connected to one first pixel 226, and the first driving unit 228 is arranged in a one-to-one correspondence with the first pixel 226, and the first driving unit 228 is arranged under the first pixel 226. The size of the first driving unit 228 varies according to its driving circuit. For example, the first driving unit 228 may be 7T1C, 5T1C, 2T1C, etc., wherein the larger the number of thin film transistors (TFTs) in the first driving unit 228, the larger the size thereof. In order to make the display effect of the first display area 220 better, the first driving unit 228 may be 7T1C, and its size is also the largest, and its size may be similar to the size of the corresponding first pixel 226.

The second driving unit 248 may also be disposed in the first display area 220. The second driving unit 248 may be a driving circuit simpler than the first driving unit 228. For example, the first driving unit 228 is 7T1C, and the second driving unit 248 is 2T1C. The number of thin film transistors included in one second driving unit 248 is less than the number of thin film transistors included in one first driving unit 228. The smaller the number of thin film transistors (TFTs) in the second driving unit 248, the smaller the size thereof, so that the second driving unit 248 may be disposed between the plurality of first driving units 228 in the first display area 220. For example, one second driving unit 248 is provided between two or four first driving units 228.

Figure 5:
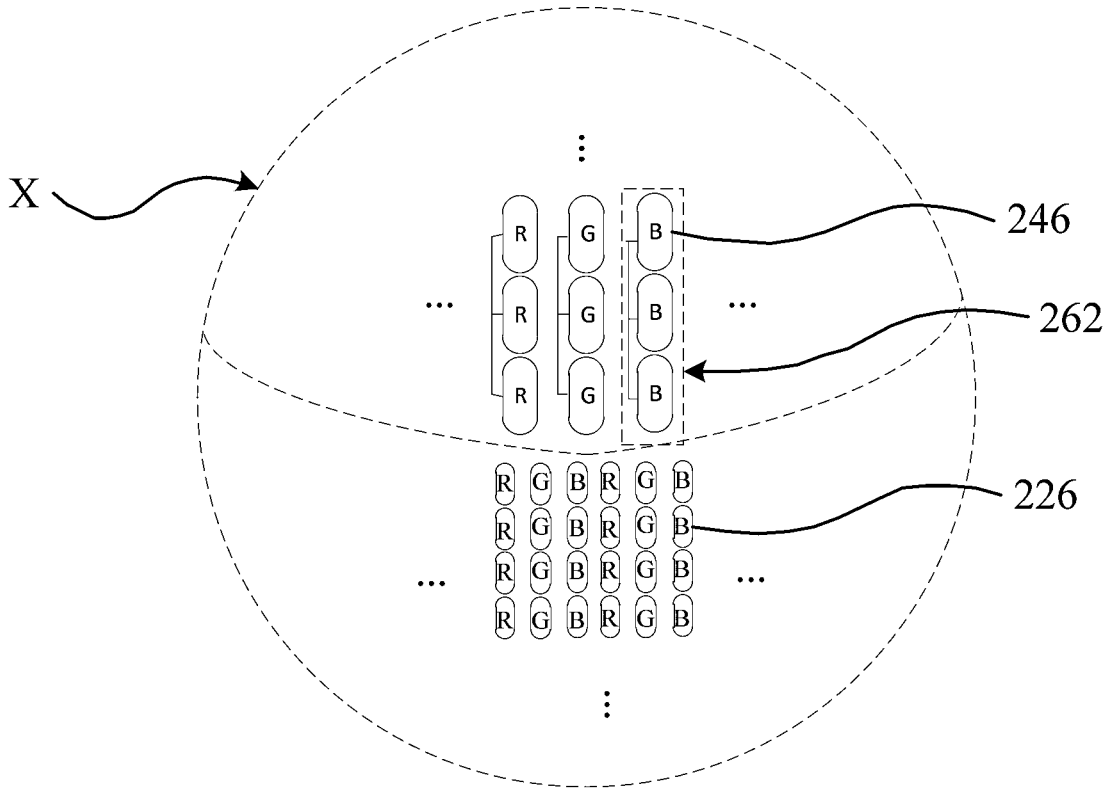
FIG. 5 is a schematic structural diagram of another pixel in the portion X of the display apparatus in FIG. 2.
Figure 6:
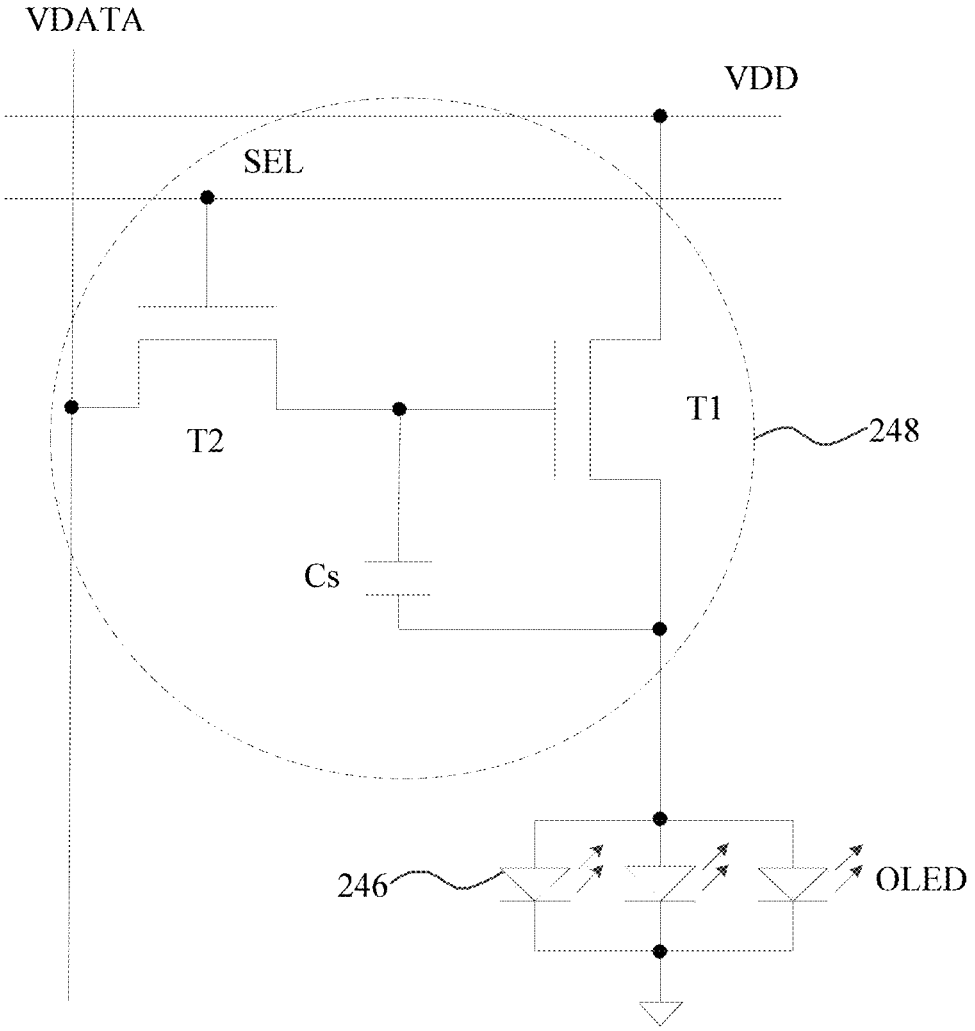
FIG. 6 is a schematic circuit diagram of a second pixel and a second driving unit of a display apparatus provided by an embodiment of the application.

Please refer to FIGS. 5-6. FIG. 5 is a schematic structural diagram of another pixel in the X portion of the display apparatus in FIG. 2, and FIG. 6 is a schematic circuit diagram of the second pixel and the second driving unit of the display apparatus provided by an embodiment of the application. The more the second driving units 248 arranged in the first display area 220, more difficult the process and the higher the cost. In order to meet the optical signal requirements of the camera for the second display area 240, it is difficult to reduce the area of the second display area 240, while the second pixels 246 of the second display area 240 can be connected in parallel to form one first pixel set 262, so that a plurality of first pixel sets 262 are obtained in the second display area 240. One first pixel set 262 is electrically connected to one second driving unit 248. One second driving unit 248 can drive all the second pixel sets 262 in one first pixel set 262. Thereby, without changing the area of the second display area 240 and the number of second pixels 246 in the second display area 240, the number of second driving units 248 that drive multiple second pixels 246 is reduced, the difficulty of arranging the second driving units 248 in the first display area 220 is reduced, the difficulty of the process is reduced, and the cost is reduced.

In order to facilitate understanding of multiple second pixels in parallel, the second driving unit of 2T1C is taken as an example for description in the following, as shown in FIG. 6, wherein VDADA is a data line, SEL can be understood as a gate line, VDD is a power supply line, and OLED is the second pixel. In the figure, an embodiment in which three second pixels are connected in parallel is shown. It is understood that other numbers, such as 2, 4, 9, 16, etc., of second pixels can be connected in parallel as required. It should be noted that the second driving unit may also be a driving circuit such as 5T1C. The parallel connection of the second pixels may be formed by the direct connection of the second pixels 246. For example, the plurality of second pixels 246 are connected in parallel by the same material as the material thereof or connected in parallel by connection lines of other materials. The parallel connection of second pixel 246 may also be connected in parallel in other ways. Specifically, the second display area may further comprise a plurality of metal anodes. One metal anode is arranged corresponding to and electrically connected to one second pixel 246, and the parallel connection of the second pixels 246 can be realized through the parallel connection of the metal anodes. Of course, the plurality of second pixels 246 connected in parallel in one pixel set 242 may be a plurality of second pixels 246 of the same color. For example, the second pixels 246 of one pixel set 242 are all red pixels, green pixels, or blue pixels.

Herein, the first pixel set 262 may comprise a plurality of second pixels 246 of the same color. For example, the first pixel set 262 may only comprise a plurality of blue second pixels 246, that is, a plurality of blue second pixels 246 are connected in parallel to form one first pixel set 262. Of course, the first pixel set 262 may also only comprise a plurality of red second pixels 246, and the first pixel set 262 may also only comprise a plurality of green second pixels 246. The first pixel set may also comprise a plurality of second pixels of different colors. For example, the first pixel set may comprise red, green, and blue second pixels.

Figure 7:
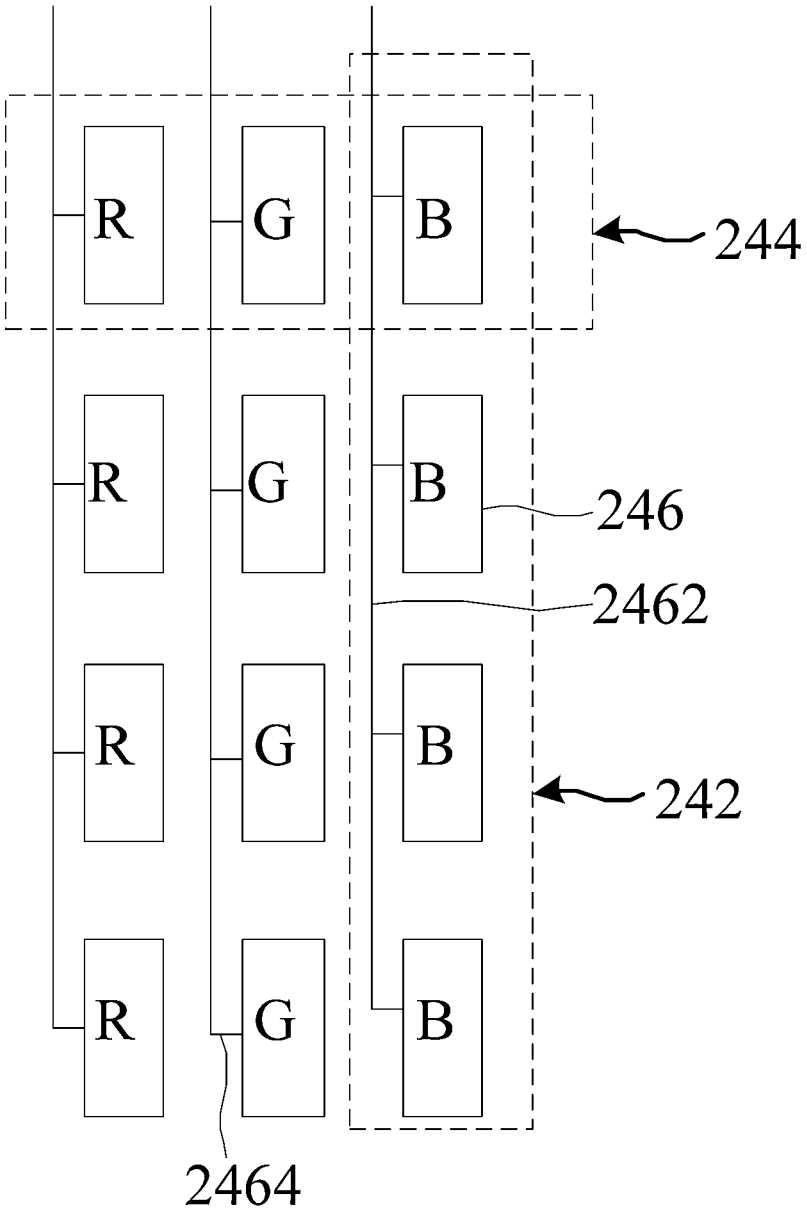
FIG. 7 is a first schematic structural diagram of a second pixel in a second display area of the display apparatus provided by an embodiment of the application.

The plurality of second pixels in second display area may be arranged in a manner of pixel units. The first pixel set can be disposed according to pixel units. Please refer to FIG. 7 for detail, which is a first schematic structural diagram of a second pixel in a second display area of the display apparatus provided by an embodiment of the application. The plurality of second pixels 246 in the second display area can be divided into a plurality of pixel units 244, the second display area comprises a plurality of pixel units 244, and each pixel unit 244 comprises at least three second pixels 246 of different colors. One pixel unit 244 in the second display area can display in mixed colors, and one pixel unit 244 can display required colors as needed. For example, one pixel unit 244 comprises second pixels 246 in three colors of R, G, and B, which can display various colors such as red, green, blue, white, pink, and cyan as required. The second pixels 246 of the same color of at least two pixel units 244 in the second display area are connected in parallel to form a first pixel set. For example, four pixel units 244 can form three first pixel sets. Specifically, four red second pixels 246 are connected in parallel to form one first pixel set, four green second pixels 246 are connected in parallel to form one first pixel set, four blue second pixels 246 are connected in parallel to form one first pixel set, and the four pixel units 244 form one display unit. The figure shows that one pixel unit 244 comprises second pixels 246 in three colors of R, G, and B. In some other embodiments, one pixel unit may also comprise second pixels 244 of multiple colors such as R, G, B, W, or R, G, B, Y, etc.

The second display area includes a gate line (not shown in the figure) and a data line. The gate line, the data line and the second driving unit cooperate to drive each second pixel 246. The gate lines and the data lines may be arranged in different layers and arranged alternately. For example, the gate lines are arranged in rows and the data lines are arranged in columns. The arrangement of the second pixels 246 in the second display area can be one of a standard RGB arrangement, a pentile arrangement or a delta arrangement. It should be noted that the data line and the second pixel 246 are not in the same layer.

Figure 8:
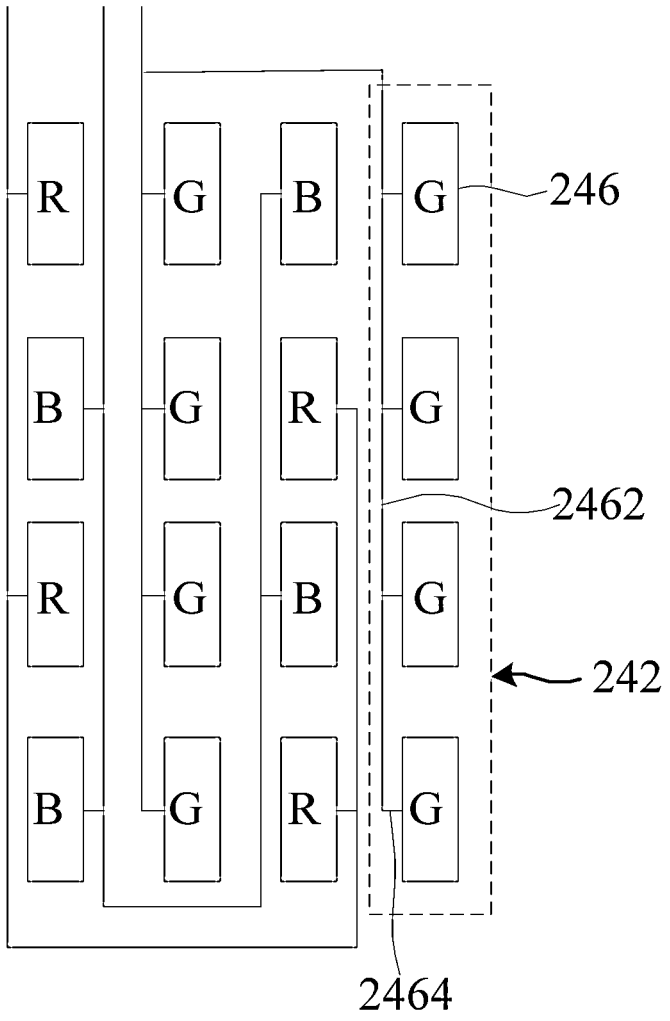
FIG. 8 is a second schematic structural diagram of the second pixel in the second display area of the display apparatus provided by an embodiment of the application.

When a plurality of second pixels 246 of the same color connected in parallel are parallel to the data line and arranged in a column, a first driving signal line 2462 is provided between two columns of second pixels 246. The first driving signal line 2462 is parallel to the data line and is electrically connected to the second pixel 246 through the second driving signal line 2464 perpendicular to the first driving signal line 2462. Different pixel arrangements have different parallel modes, as specifically shown in FIG. 7 and FIG. 8.

Figure 9:
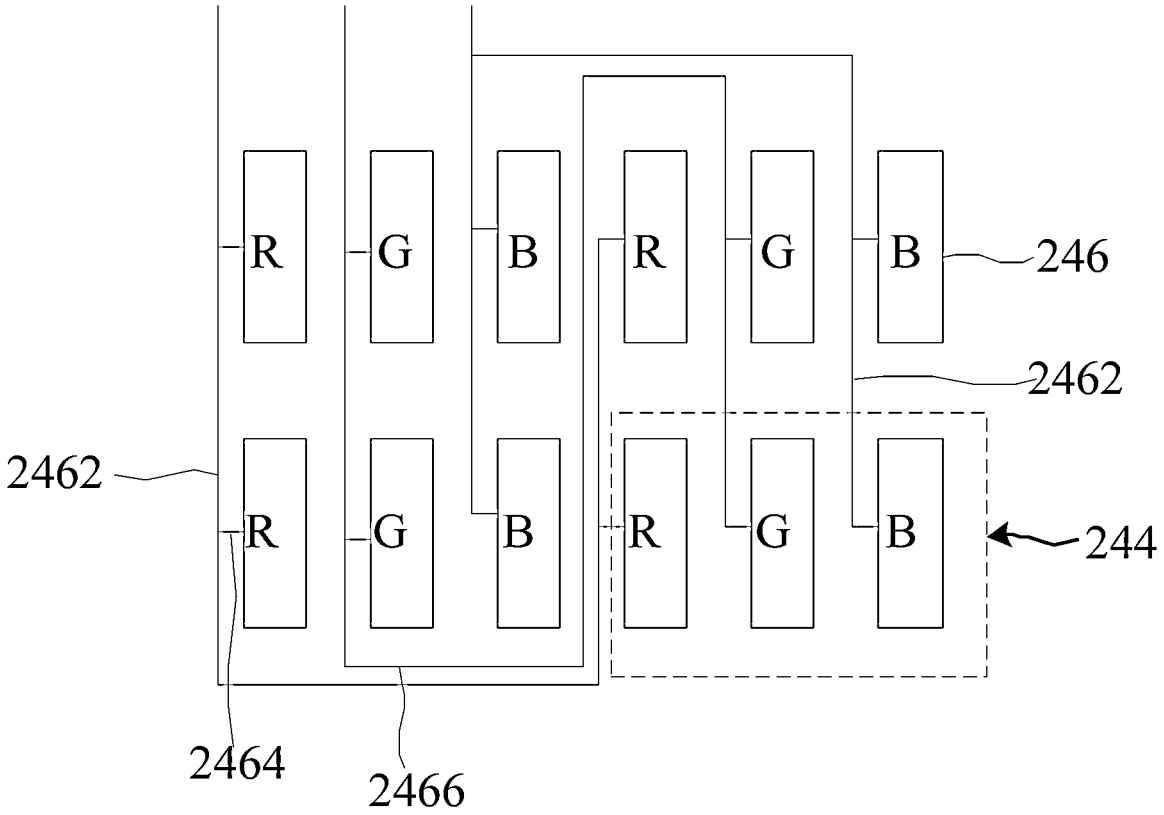
FIG. 9 is a third schematic structural diagram of the second pixel in the second display area of the display apparatus according to an embodiment of the application.
Figure 10:
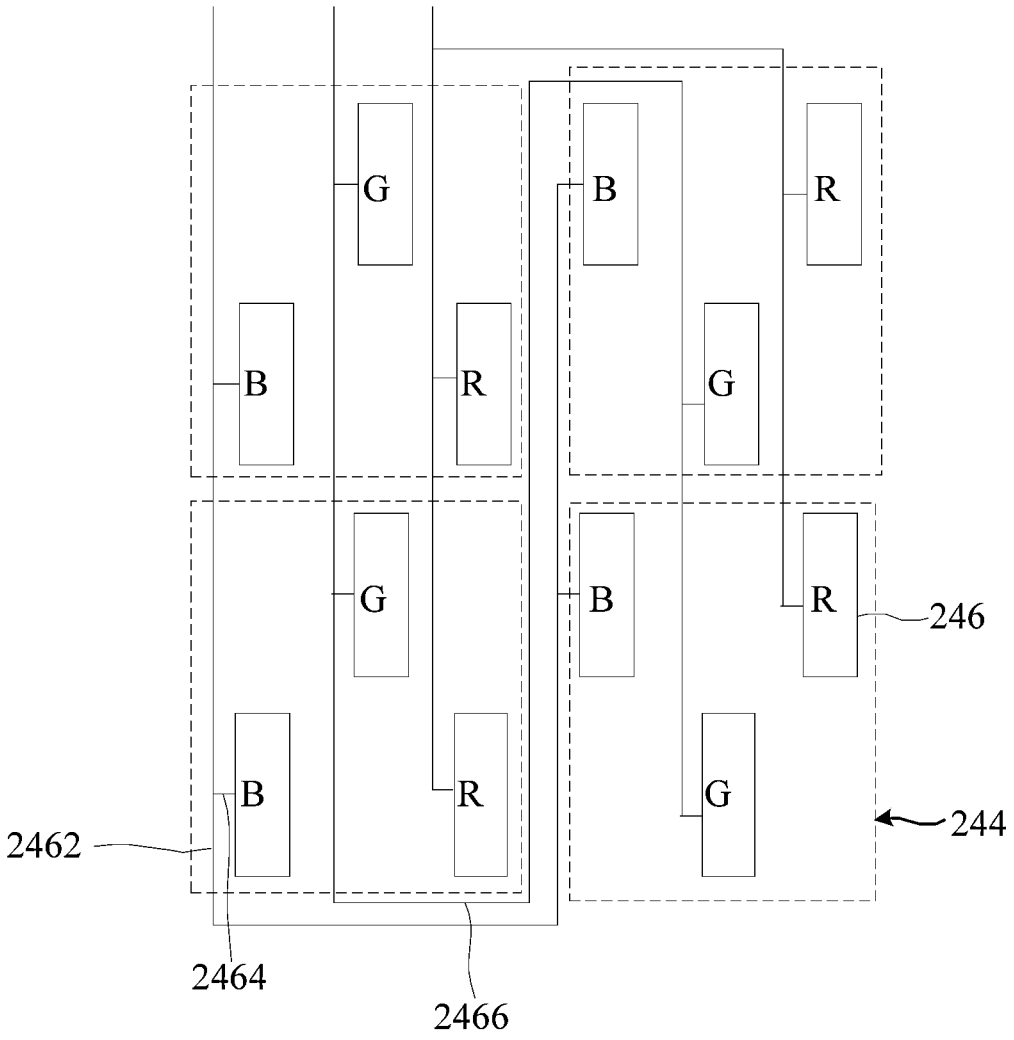
FIG. 10 is a fourth schematic structural diagram of the second pixel in the second display area of the display apparatus according to an embodiment of the application.

When the plurality of parallel second pixels of the same color are arranged in an array, the second pixels have different parallel modes. Please refer to FIGS. 9-10 for details. FIG. 9 is a third schematic structural diagram of the second pixel in the second display area of the display apparatus provided by an embodiment of the application, and FIG. 10 is a fourth schematic structural diagram of the second pixel in the second display area of the display apparatus provided by an embodiment of the application. When a plurality of parallel second pixels 246 of the same color are arranged in an array, two adjacent second pixels 246 of the same color parallel to the data line direction are connected in parallel by the first driving signal line 2462, and the first driving signal line 2462 is parallel to the data line. The adjacent second pixels 246 of the same color that are perpendicular to the data line direction are connected in parallel through the second driving signal line 2464, wherein the second driving signal lines 2464 connecting the second pixels 246 of different colors are arranged at intervals.

For ease of understanding, FIGS. 9-10 are taken as an example for description. FIG. 9 shows a schematic diagram of the second pixels of a standard RGB arrangement in the second display area, and FIG. 10 shows a schematic diagram of the second pixels of a delta arrangement in the second display area. A plurality of second pixels 246 are arranged in an array, and the R, G, and B second pixels 246 of the same color are all arranged in an array. Two adjacent pixels of the same color in a column are provided next to one first driving signal line 2462, and are connected in parallel through the second driving signal line 2464 perpendicular to the first driving signal line 2462. Specifically, the adjacent second pixels of the same color in a column are next to one first driving signal line 2462, and are connected in parallel through the second driving signal line 2464 perpendicular to the first driving signal line 2462. Among the adjacent second pixels of the same color in a row, the B second pixel directly connects two first driving signal lines 2462 in parallel at one end, the R second pixel directly connects two first driving signal lines 2462 in parallel at the other end, and the G second pixels are connected in parallel through a third driving signal line 2466. The third driving signal line 2466 bypasses the B second pixels and the R second pixels arranged between two columns of G second pixels, and the drive signal line connecting the R second pixels at intervals.

Figure 11:
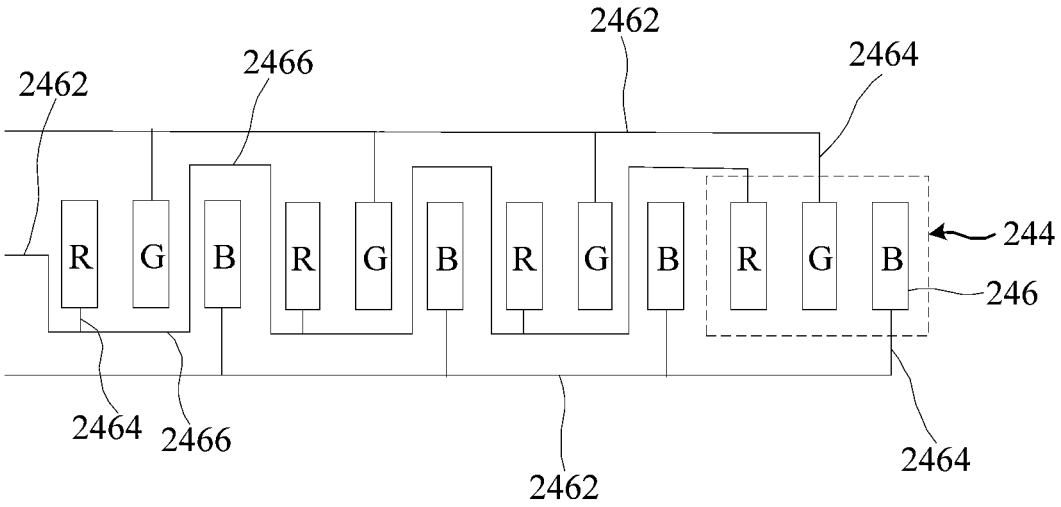
FIG. 11 is a fifth schematic structural diagram of the second pixel in the second display area of the display apparatus according to an embodiment of the application.

When multiple second pixels of the same color connected in parallel are perpendicular to the data line, the second pixels have different parallel modes. Please refer to FIG. 11 for details. FIG. 11 is a fifth schematic structural diagram of the second pixel in the second display area of the display apparatus provided by an embodiment of the application. The arrangement of the second pixels 246 in the second display area is a standard RGB arrangement or a pentile arrangement. A plurality of second pixels 246 of the same color connected in parallel are perpendicular to the data line, and a first driving signal line 2462 is arranged in a direction perpendicular to the data line. The first driving signal line 2462 is electrically connected to the second pixels 246 through a second driving signal line 2464 perpendicular to the first driving signal line 2462, wherein the second driving signal lines connected to the second pixels 246 of different colors are arranged at intervals. For ease of understanding, FIG. 11 is taken as an example for detailed description in the following. One first driving signal line 2462 is provided on each side of a plurality of second pixels 246 of the same color, one first driving signal line 2462 is provided in the middle, and a plurality of G second pixels 246 are electrically connected to the first driving signal line 2462 through a plurality of second driving signal lines 2464 perpendicular to the first driving signal line 2462, to realize parallel connection of the plurality of G second pixels. Parallel connection of the plurality of B second pixels 246 are realized with a connection manner similar to the G second pixels. The first driving signal line 2462 electrically connected to the R second pixel 246 is provided at an end. The second display area also includes a third driving signal line 2466 connecting a plurality of R second pixels 246 in parallel. The third driving signal line 2466 avoids the driving signal lines electrically connected to the G second pixel 246 and the B second pixel 246 to connect a plurality of R second pixels 246 in parallel. Specifically, the third driving signal line 2466 bypasses the G second pixel 246 along the opposite side of the second driving signal line 2464 connected to the G second pixel 246, and also bypasses the B second pixel 246 along the opposite side of the second driving signal 2464 connected to the B second pixel 246.

In addition to the second pixels of the same color in different second pixel units being connected in parallel to form a first pixel set, the second pixels in one second pixel unit can also be connected in parallel with the second pixels in at least one of other second pixel units to form a first pixel set. For example, the R pixel of one second pixel unit and the G pixel and B pixel of another second pixel unit are connected in parallel to form a first pixel set. For another example, the R pixel of one second pixel unit, the G pixel of another second pixel unit, and the B pixel of the third second pixel unit are connected in parallel to form a first pixel set. Mixed-color display can be performed as required. For example, the second display area is displayed with a specific icon, and the second pixels in the second display area can be connected in parallel according to the specific icon.

Figure 12:
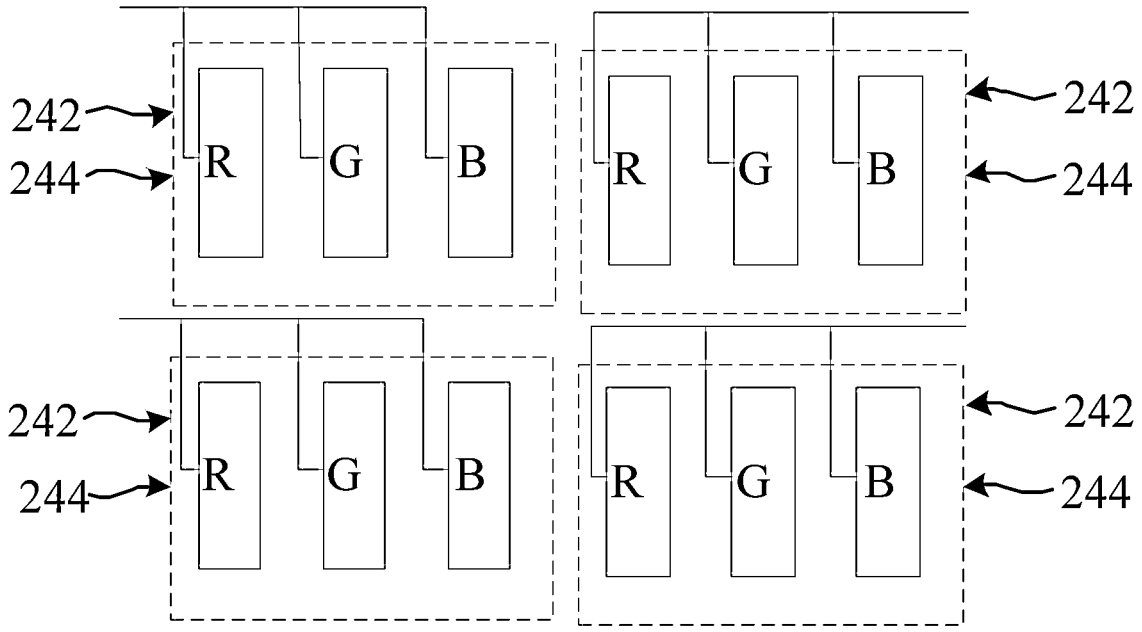
FIG. 12 is a sixth schematic structural diagram of the second pixel in the second display area of the display apparatus according to an embodiment of the application.

In addition, the first pixel set may also be formed by connecting at least two second pixels of different colors in the same pixel unit in parallel. As shown in FIG. 12, the R pixels, B pixels, and G pixels in the first pixel set are connected in parallel to form the first pixel set. Mixed-color display can be performed as required. For example, the second display area is displayed with a specific icon, and the second pixels in the second display area can be connected in parallel according to the specific icon. For example, the second display area displays signal icons (4G, 5G, WIFI, etc.), alarm clock icons, etc. The second display area only needs to display white or black alarm clock icons, etc. It should be noted that, the second pixels of only two colors can be connected in parallel, and the second pixels of the other color can be driven separately.

It should be noted that the display apparatus may also only comprise a first display area and a second display area. The first display area comprises a plurality of first pixels and a plurality of first driving units, and one first driving unit drives one first pixel. The second driving unit is arranged in the first display area. For example, one second driving unit being arranged between the plurality of first driving units, can also be understood that the space between the plurality of first driving units is used for accommodating one second driving unit. In order to better arrange the second driving unit in the first display area, the distribution density of the first driving units in the first display area may be appropriately reduced, so as to better accommodate the second driving unit.

Figure 13:
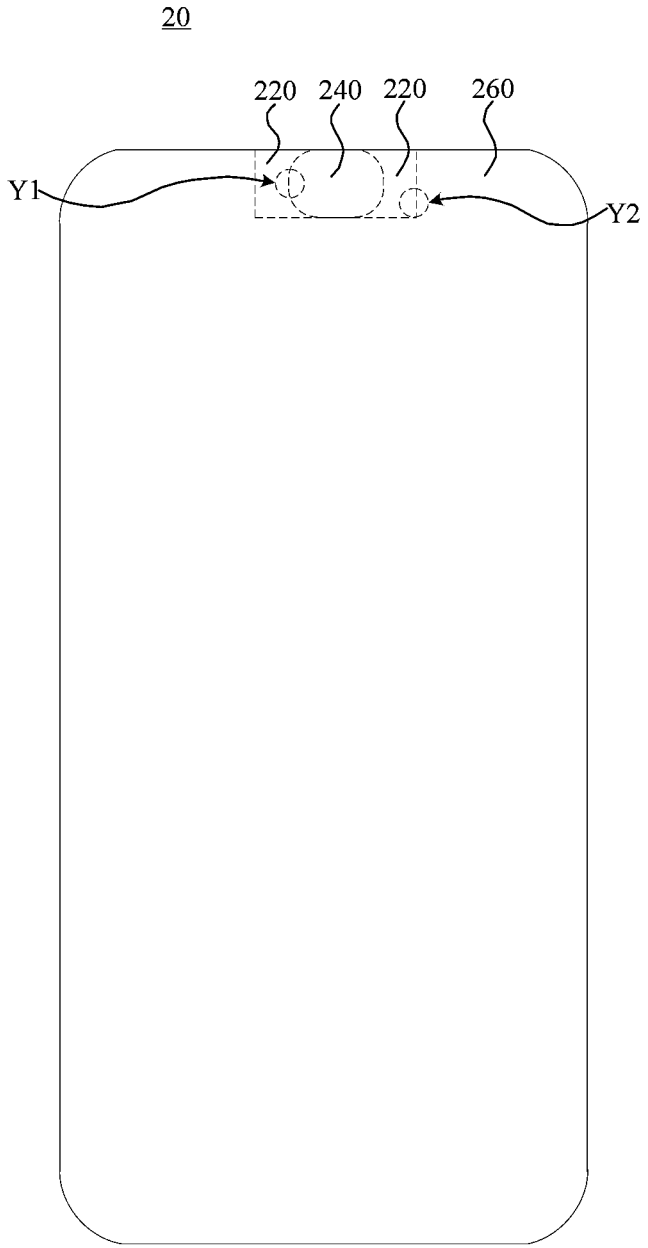
FIG. 13 is a second schematic structural diagram of a display apparatus provided by an embodiment of the application.
Figure 14:
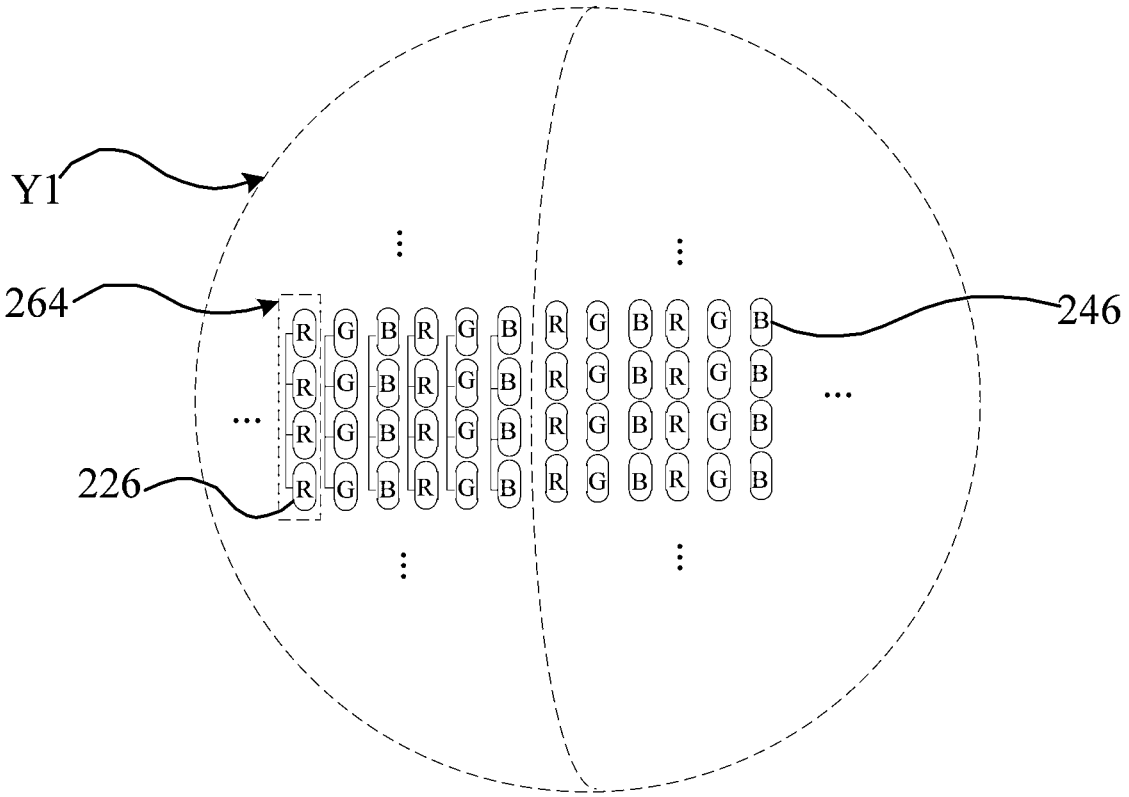
FIG. 14 is a schematic structural diagram of a pixel in a portion Y1 of the display apparatus in FIG. 13.
Figure 15:
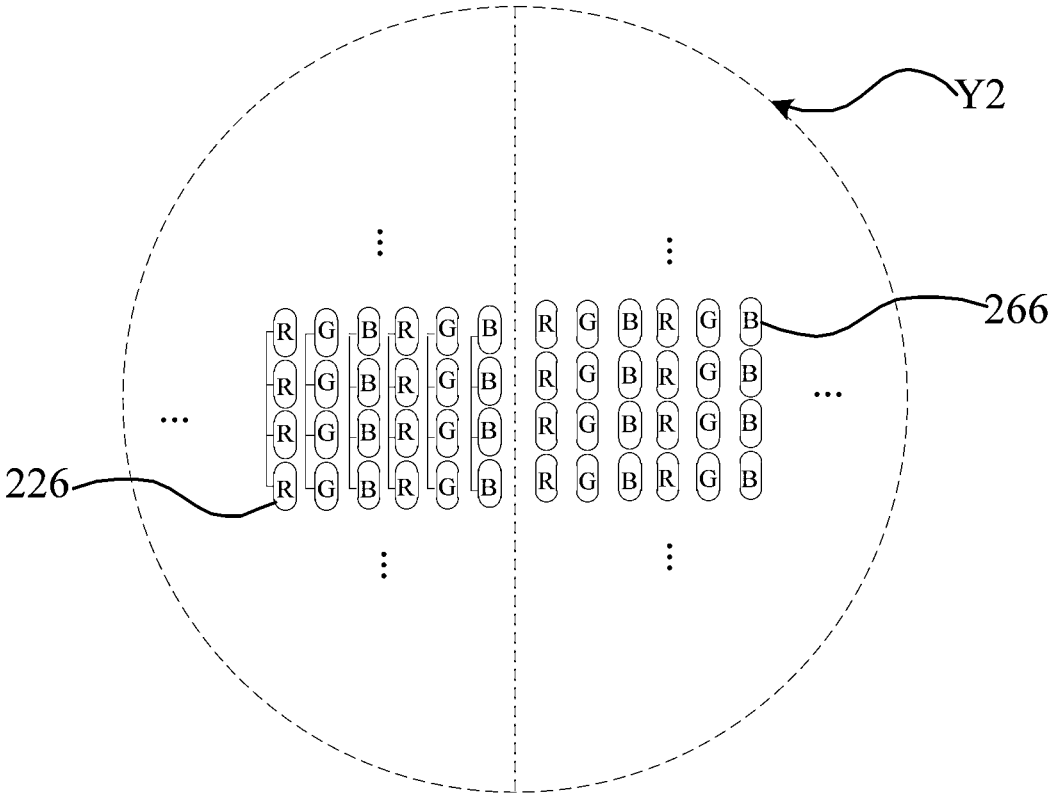
FIG. 15 is a schematic structural diagram of a pixel structure in a portion Y2 of the display apparatus in FIG. 13.

Please refer to FIGS. 13 and 14. FIG. 13 is a second schematic structural diagram of the display apparatus provided by an embodiment of the application, FIG. 14 is a schematic structural diagram of the pixel in the Y1 portion of the display apparatus in FIG. 13, and FIG. 15 is a schematic structural diagram of the pixel in the Y2 portion of the display apparatus in FIG. 13. The display apparatus may further comprise a third display area 260, and the third display area 260 is connected to the second display area 240 via the first display area 220.

The first display area 220 is adjacent to the second display area 240, and the area of the first display area 220 is much smaller than that of the third display area 260, which serves as the main display area of the display apparatus. It should be noted that the first display area 220 in the figure is disposed on both sides of the second display area 240. In some other embodiments, the first display area may surround the second display area.

The third display area 260 comprises a plurality of third pixels 266 and a plurality of third driving units. One third driving unit is electrically connected to one third pixel 266 and drives the third pixel 266.

The physical structure of the pixels in the first display area and the third display area may be the same. The size, arrangement, and distribution density of the first pixels in the first display area and the third pixels in the third display area may be the same. The first pixels and the third pixels can be processed in the same process, without additional processes, and without changing the operating equipment. The first pixel and the third pixel can be formed in one process, which simplifies the processing process, improves the processing efficiency, and reduces the cost.

The plurality of first pixels 226 of the first display area 220 are connected in parallel to form one second pixel set 264, obtaining a plurality of the second pixel sets 264. It can also be understood that the first display area 220 comprises a plurality of second pixel sets 264, and each second pixel set 264 comprises at least two first pixels 226 connected in parallel. A plurality of first pixel 226 connected in parallel in one second pixel sets 264 are electrically connected to one first driving unit 228. The plurality of first pixels 226 in the first display area 220 share one first driving unit 228. The first driving unit is not provided under some of the first pixels, and the first display area 220 has an accommodation space in a layer where the first driving unit 228 is provided. The accommodation space can be used to accommodate the second driving unit 248.

Figure 16:
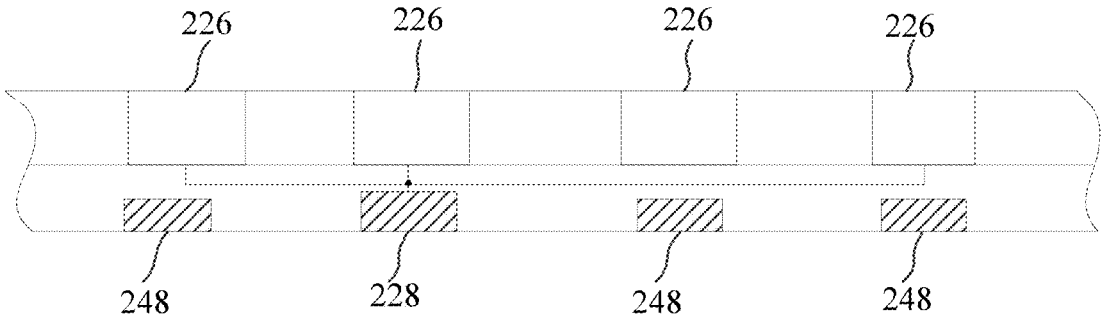
FIG. 16 is a partial schematic structural diagram of a first display area of the display apparatus provided by an embodiment of the application.

Herein, a second pixel set 264 can be arranged corresponding to one first driving unit 228 and at least one second driving unit 248, as shown in FIG. 16.

For example, one first pixel 226 in a second pixel set 264 is arranged corresponding to one first driving unit 228, and another first pixel 226 is further arranged corresponding to one second driving unit 248. For example, the second pixel set 264 comprises four first pixels 226, one first pixel 226 is arranged with one first driving unit 228, and the other three first pixels 226 are arranged corresponding to one second driving unit 248, respectively.

In another example, because the second driving unit 248 can be 2T1C and the size of the second driving unit 248 is small, one first pixel 226 in a second pixel set 264 is arranged corresponding to one first driving unit 228, and another pixel 226 is further provided corresponding to at least two second driving units 248. It can also be understood that at least two second driving units 248 are disposed under one first pixel 226. For example, the second pixel set 264 comprises two first pixels 226, wherein one first pixel 226 is arranged with one first driving unit 228, and the other first pixel 226 is arranged corresponding to two second driving units 248.

It should be noted that the parallel connection of multiple first pixels in the first display area may adopt a structure similar to the parallel connection of multiple second pixels in the second display area, which will not be repeated here.

The second pixel 246 of the second display area 240 may have the same structure as the first pixel 226 of the first display area 220. For example, the second pixels 246 of the second display area 240 and the first pixels 226 of the first display area 220 have the same size, the same spacing, the same arrangement, etc.

In order to further increase a light transmittance of the second display area 240, a distribution density of the second pixels 246 in the second display area 240 may be less than a distribution density of the first pixels 226 in the first display area 220, or it may be less than a distribution density of the third pixels in the third display area.

For example, please continue to refer to FIG. 5, the size of the second pixel 246 is larger than the size of the first pixel 226, and the spacing between the second pixels 246 is positively correlated with the size of the second pixel 246, that is, the larger the size of the second pixel 246, the greater the separation distance between the second pixels 246. Therefore, the distribution density of the second pixels 246 in the second display area 240 is smaller than the distribution density of the first pixels 226 in the first display area 220. A pixel definition layer is provided between the second pixels 246. The light transmittance of the pixel definition layer is greater than the light transmittance of the second pixel 246. The smaller the distribution density of the second pixels 246, the smaller the area ratio occupied by the second pixels 246, and the higher an area ratio occupied by the pixel definition layer, and the higher the light transmittance of the second display area 240. It should be noted that in some other embodiments, a plurality of second pixels may not be connected in parallel, that is, each second pixel in the second display area corresponds to one second driving unit.

In another example, the size of the second pixel is the same as the size of the first pixel, and the spacing between the second pixels is greater than the spacing between the first pixels, so that the distribution density of the second pixels in the second display area is smaller than the distribution density of the first pixels in the first display area. The light transmittance of the pixel definition layer is greater than that of the second pixel. The smaller the distribution density of the second pixels, the smaller the area ratio occupied by the second pixel, and the higher the area ratio occupied by the pixel definition layer, and the higher the light transmittance of the second display area.

Figure 17:
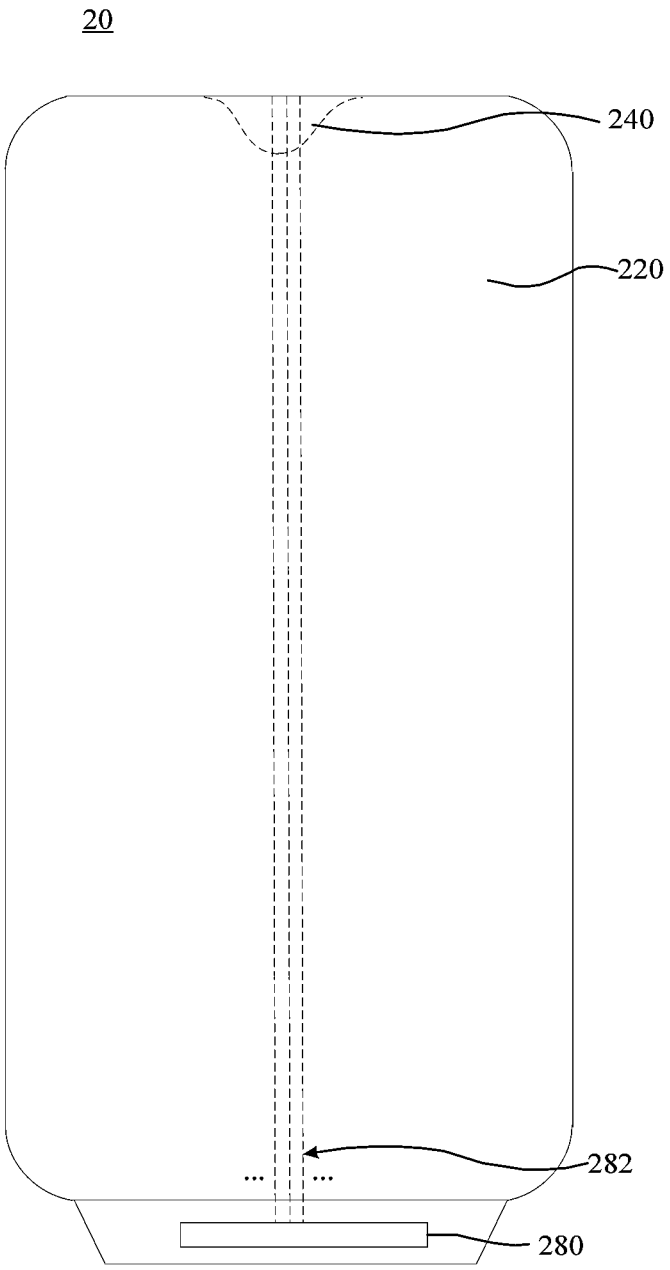
FIG. 17 is a third schematic structural diagram of a display apparatus provided by an embodiment of the application.

Please refer to FIG. 17, which is a third schematic structural diagram of the display apparatus provided by an embodiment of the application. The display apparatus may further comprise a driving chip 280 and a plurality of driving signal lines 282. The driving chip 280 controls the first driving unit 228 and the second driving unit 248 through the plurality of driving signal lines 282, and the first display area 220 and the second display area 240 can be controlled by the same driving chip 280. At least one of the driving signal lines 282 is connected to the first driving unit 228 and the second driving unit 248. There is no need to purposely provide a driving chip 280 and a driving signal line 282 for the second display area 240, and the driving chip 280 and the driving signal line 282 can be shared with the first display area 220, which is convenient for laying the driving signal line 282. Herein, the driving signal line 282 may be at least one of a gate line and a data line. It should be noted that if the display apparatus only comprises the first display area and the second display area, the first display area and the second display area may both be active matrix organic light-emitting diode (AMOLED) display areas, and both the first pixel in the first display area and the second pixel in the second display area may be actively driven. If the display apparatus further comprises a third display area, the third display area may also be an active matrix organic light emitting diode (AMOLED) display area, and the third pixel is also actively driven.

It should be noted that the display apparatus in the above embodiment may be the display apparatus in the electronic device shown in FIG. 1. It can also be understood that the electronic device shown in FIG. 1 comprises a display apparatus, and the structure of the display apparatus of the electronic device may be the structure of the display apparatus in any of the above-mentioned embodiments. Details may be referred to in the above-mentioned embodiments, and will not be repeated here.

Figure 18:
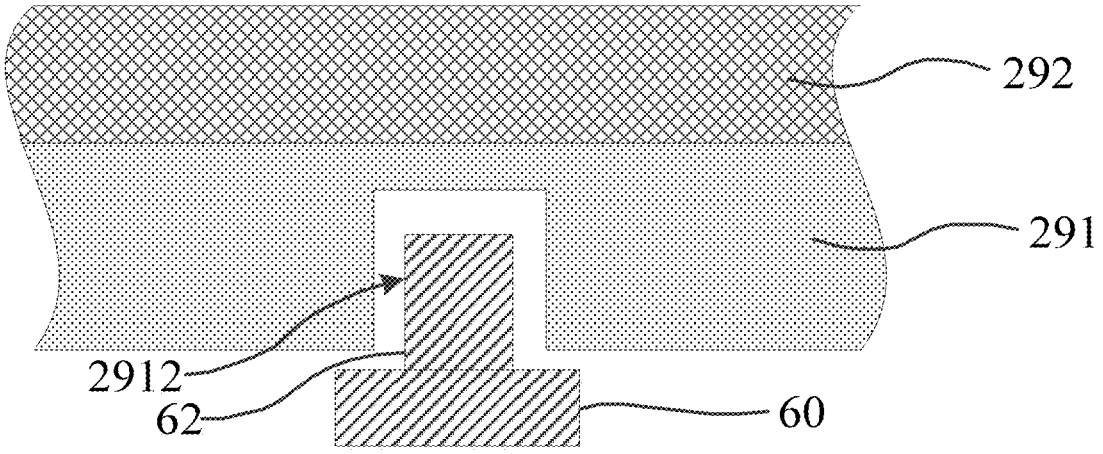
FIG. 18 is a first schematic structural diagram of a display apparatus and a camera provided by an embodiment of the application.

In the electronic device, a lens of the camera faces the substrate of the display apparatus, and the camera is used to form images by obtaining external light signals passing through the second display area. In order to reduce the space occupied by the camera, the lens of the camera can be close to or adjacent to the substrate of the display apparatus. The substrate of the display apparatus is mainly used to carry other layer structures of the display apparatus, and does not need special functions. In order to further reduce the space occupied by the camera, the camera portion can be arranged in the substrate. Please refer to FIG. 18 for details. FIG. 18 is a first schematic structural diagram of a display apparatus and a camera provided by an embodiment of the application. The display apparatus also comprises a substrate 291 and a driving circuit layer 292 that are stacked, and there are other layers (not shown in the figure) on the driving circuit layer 292, such as an anode layer, a light-emitting layer, a protective layer, a polarizer, and the like. A first mounting hole 2912 is provided at a position of the substrate 291 facing the camera 60, and the camera 60 is at least partially disposed in the first mounting hole 2912. The first mounting hole 2912 may be a blind hole, that is, a thickness of the part of the substrate 291 facing the camera 60 is smaller than the thickness of other parts. The substrate 291 is still a complete substrate 291, which does not affect its function of carrying other layer structures of the display apparatus 20, and can also vacate a space for accommodating the camera 60. The installation manner of the first mounting hole 2912 and the camera 60 can be set according to the size of the first mounting hole 2912 and the size of the camera 60. For example, if the space of the first mounting hole 2912 is not enough to install the entire camera 60, the lens 62 of the camera 60 is partially disposed in the first mounting hole 2912. If the camera 60 is sufficiently small, the entire camera 60 is set in the first mounting hole 2912.

Figure 19:
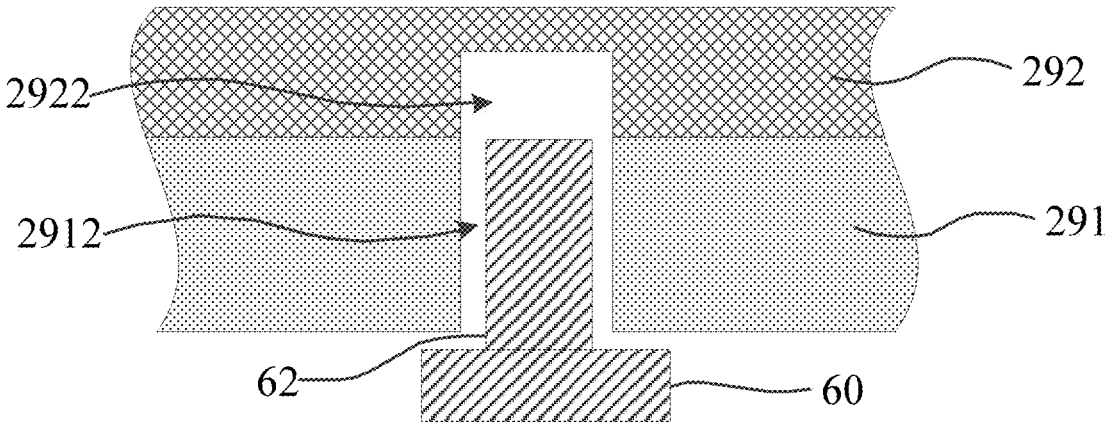
FIG. 19 is a second schematic structural diagram of a display apparatus and a camera provided by an embodiment of the application.

Because the driving circuit layer of the second display area is not provided with a second driving unit, and the driving circuit layer has no special function, the camera can be installed in the driving circuit layer. Please refer to FIG. 19 for details. FIG. 19 is a second schematic structural diagram of a display apparatus and a camera provided by an embodiment of the present application. The first mounting hole 2912 is a through hole. The driving circuit layer 292 of the second display area 240 has a second mounting hole 2922 facing the camera 60. The first mounting hole 2912 and the second mounting hole 2922 are communicated, and the camera 60 may be at least partially located in the second mounting hole 2922. For example, the lens 62 of the camera 60 is located in the first mounting hole 2912 and the second mounting hole 2922. The second mounting hole 2922 may be a through hole or a blind hole. The first mounting hole 2912 and the second mounting hole 2922 can be made after the partial laminated structure of the display apparatus 20 is formed. For example, after the drive circuit layer, anode layer, light-emitting layer, and common electrode layer of the display apparatus 20 are all disposed on the substrate 291, the first mounting hole 2912 and the second mounting hole 2922 are made by laser or the like corresponding to the position of the lens 62 of the camera 60.

It should be noted that the camera 60 facing the second display area 240 can be used as a front camera 60 of the electronic device. The front camera is generally a camera with a lens that cannot be moved. The substrate 291 and the drive circuit layer 292 of the display apparatus can be provided with a first installation hole 2912 and a second mounting hole 2922. The camera 60 facing the second display area 240 can be a camera 60 with a movable lens 62, and the lens 62 of the camera 60 can be movable for realizing functions such as auto-focus. If the lens 62 of the camera 60 can be moved for functions such as auto-focusing, the lens 62 of the camera 60 can be located in the second mounting hole 2922 when needed, and not located in the second mounting hole 2922 in some cases.

It can be understood that, in any of the above embodiments, the size and shape of the second pixel in the second display area can be set as required. For example, the second pixel may be rectangular or circular-like. The second pixel that is circular-like may be a circle, an ellipse, a rounded rectangle, or the like. Because the edge of the circular-like second pixel has an arc-shaped transition, the diffraction problem in the second display area can be improved.

The display apparatus may have a regular shape, such as a rectangle, a rounded rectangle, or a circle. Of course, in some other possible embodiments, the display apparatus may also have an irregular shape, which is not limited in the embodiment of the present application.

One camera or multiple cameras can be set under the second display area. Multiple cameras can be cameras that cooperate with each other, such as two identical cameras, one normal camera and one virtual camera or black-and-white camera. Under the second display area, in addition to the camera, may also be provided with other functional devices, such as proximity sensors, light sensor, distance measuring sensor, fingerprint recognition sensor, etc.

For more comprehensive understanding of the electronic devices in the embodiments of the present application, the structure of the electronic device is further explained below. Please continue to refer to FIG. 1, the electronic device 10 further comprises a housing 40 and a camera 60.

The housing 40 may comprise a back cover (not shown in the figure) and a frame 420, and the frame 420 is arranged around a periphery of the back cover. The display apparatus 20 may be disposed in the frame 420, and the display apparatus 20 and the back cover may be used as two opposite sides of the electronic device 10. The camera 60 is provided between the back cover of the housing 40 and the display apparatus 20. The display apparatus 20 may be an organic light-emitting diode (OLED) display apparatus 20. The display apparatus 20 may be a full screen, that is, the display surface of the display apparatus 20 is almost a display area. The display apparatus 20 may also be provided with a cover plate. The cover plate covers the display apparatus 20 to protect the display apparatus 20 and prevent the display apparatus 20 from being scratched or damaged. Herein, the cover plate may be a transparent glass cover plate, so that a user can observe the information displayed by the display apparatus 20 through the cover plate. For example, the cover plate may be a cover plate made of sapphire.

Electronic devices can also comprise a circuit board, a battery, and a middle plate. The frame 420 is arranged around the middle plate, wherein the frame 420 and the middle plate may form a middle frame of the electronic device 10. The middle plate and the frame 420 form an accommodation cavity on both sides of the middle plate. One accommodation cavity is used for accommodating the display apparatus 20, and the other accommodation cavity is used for accommodating the circuit board, battery and other electronic components or functional components of the electronic device 10.

Among them, the middle plate may have a thin plate or sheet-like structure, or a hollow frame structure. The middle frame is used to provide support for the electronic components or functional components in the electronic device 10 so as to install the electronic components and functional components in the electronic device 10 together. The camera 60, receiver, battery and other functional components of the electronic device 10 can all be mounted on the middle frame or circuit board for fixing. It is understandable that the material of the middle frame may include metal or plastic.

The circuit board can be installed on the middle frame. The circuit board may be a mother board of the electronic device 10. Herein, the circuit board may be integrated with one or more of functional components such as a microphone, a speaker, a receiver, a headphone interface, an acceleration sensor, a gyroscope, and a processor. At the same time, the display apparatus 20 may be electrically connected to the circuit board to control the display of the display apparatus 20 through a processor on the circuit board. The display apparatus 20 and the camera 60 may both be electrically connected to the processor; when the processor receives a shooting instruction, the processor controls the second display area to turn off the display, and controls the camera 60 to collect images through the second display area 240. When the processor does not receive a shooting instruction and receives an image display instruction, the processor controls the first display area 220 and the second display area 240 to display images together.

It is understood that if the display apparatus only comprises the first display area and the second display area, the processor can independently control whether the first display area displays. If the display apparatus comprises a first display area, a second display area, and a third display area, the processor is not only used to control whether the first display area displays, but also to control the third display area, that is, to control the first display area and the third display area at the same time to display together or not.

The battery can be installed on the middle frame. At the same time, the battery is electrically connected to the circuit board, so that the battery can supply power to the electronic device 10. Herein, a power management circuit may be provided on the circuit board. The power management circuit is used to distribute the voltage provided by the battery to various electronic components in the electronic device 10.

It should be understood that the "plurality" mentioned herein refers to two or more.

The display apparatus and electronic device provided in the embodiments of the present application have been described in detail above. Specific examples are used in this article to describe the principle and implementation of the application, and the description of the above examples is only used to help understand the application. At the same time, for those skilled in the art, according to the idea of the application, there will be changes in the specific implementation and the application scope. In summary, the content of this specification should not be construed as a limitation to the application.

What is claimed is:

1. A display apparatus, comprising:

a first display area comprising a plurality of first pixel sets and a plurality of first driving units, wherein each of the first pixel sets comprises at least two first pixels connected in parallel, and each of the first driving units is electrically connected to one of the first pixel sets to drive the first pixels in the one of the first pixel sets;

a second display area disposed adjacent to the first display area and comprising a plurality of second pixels; and a plurality of second driving units arranged in the first display area, wherein each of the second driving units is electrically connected to and drives one or more of the second pixels, the number of thin film transistors included in each of the second driving units is smaller than the number of thin film transistors included in each of the first driving units, each of the first driving units is arranged corresponding to one of the first pixels in one of the first pixel sets, and each of the second driving units is arranged corresponding to another one of the first pixels in the one of the first pixel sets.

2. The display apparatus according to claim 1, wherein the second display area comprises a plurality of second pixel sets, each of the second pixel sets comprises a plurality of the second pixels connected in parallel, and each of the second driving units is electrically connected to all the second pixels connected in parallel in one of the second pixel sets.

3. The display apparatus according to claim 2, wherein the second pixel set comprises a plurality of the second pixels of different colors, or the second pixel set comprises a plurality of the second pixels of the same color.

4. The display apparatus according to claim 2, wherein the second display area comprises a plurality of pixel units, and each of the pixel units comprises at least three second pixels of different colors; and a second pixel in one of the pixel units is connected in parallel with a second pixel in at least one of the other pixel units, and the at least two second pixels connected in parallel form the second pixel set.

5. The display apparatus according to claim 4, wherein the second pixels of the same color in the at least two pixel units are connected in parallel, and the at least two second pixels of the same color connected in parallel form the second pixel set.

6. The display apparatus according to claim 2, wherein the second display area comprises a plurality of pixel units, and each of the pixel units comprises at least three second pixels of different colors; and at least two second pixels of different colors in the pixel unit are connected in parallel, and the at least two second pixels of different colors connected in parallel form the second pixel set.

7. The display device according to claim 1, wherein the first driving unit is 7T1C or 5T1C, and the second driving unit is 2T1C.

8. The display apparatus according to claim 1, further comprising a third display area, wherein the third display area is connected to the second display area via the first display area, the third display area comprises a plurality of third pixels and a plurality of third driving units, and each of the third driving units is electrically connected to one of the third pixels.

9. The display apparatus according to claim 8, wherein the first pixel set comprises a plurality of the first pixels of different colors, or the first pixel set comprises a plurality of the first pixels of the same color.

10. The display apparatus according to claim 1, wherein the display apparatus further comprises a driving chip and a plurality of driving signal lines, the driving chip controlling the first driving unit and the second driving unit through the plurality of driving signal lines, wherein at least one of the driving signal lines is electrically connected to the first driving unit and the second driving unit.

11. The display apparatus according to claim 1, wherein a distribution density of the second pixels is smaller than a distribution density of the first pixels.

12. An electronic device, comprising a display apparatus and a camera, wherein the display apparatus comprises:

a first display area comprising a plurality of first pixel sets and a plurality of first driving units, wherein each of the first pixel sets comprises at least two first pixels connected in parallel, and each of the first driving units is electrically connected to one of the first pixel sets to drive the first pixels in the one of the first pixel sets;

a second display area disposed adjacent to the first display area and comprising a plurality of second pixels; and a plurality of second driving units arranged in the first display area, wherein each of the second driving units is electrically connected to and drives one or more of the second pixels the number of thin film transistors included in each of the second driving units is smaller than the number of thin film transistors included in each of the first driving units, each of the first driving units is arranged corresponding to one of the first pixels in one of the first pixel sets, and each of the second driving units is arranged corresponding to another one of the first pixels in the one of the first pixel sets; and the camera comprises a lens disposed toward the second display area, and the camera being used to form images by obtaining external light signals passing through the second display area.

13. The electronic device according to claim 12, wherein the second display area comprises a plurality of second pixel sets, each of the second pixel sets comprises a plurality of the second pixels connected in parallel, and each of the second driving units is electrically connected to all the second pixels connected in parallel in one of the second pixel sets.

14. The electronic device according to claim 13, wherein the second display area comprises a plurality of pixel units, and each of the pixel units comprises at least three second pixels of different colors; and a second pixel in one of the pixel units is connected in parallel with a second pixel in at least one of the other pixel units, and the at least two second pixels connected in parallel form the second pixel set.

15. The electronic device according to claim 14, wherein the second pixels of the same color in the at least two pixel units are connected in parallel, and the at least two second pixels of the same color connected in parallel form the second pixel set.

16. The electronic device according to claim 12, wherein the display apparatus further comprises a third display area, and the third display area is connected to the second display area via the first display area, the third display area comprises a plurality of third pixels and a plurality of third driving units, and each of the third driving units is electrically connected to one of the third pixels.

17. The electronic device according to claim 12, wherein the display apparatus further comprises a substrate, a driving unit layer, and a light-emitting layer, wherein the driving unit layer is disposed on the substrate, and the light-emitting layer is disposed on the driving unit layer; and the substrate is disposed between the camera and the light-emitting layer, wherein the substrate has a first mounting hole facing the second display area, and the camera lens is at least partially located in the first mounting hole.

18. The electronic device according to claim 17, wherein the drive unit layer has a second mounting hole facing the camera lens, wherein the second mounting hole communicates with the first mounting hole, and the camera lens is at least partially located in the second mounting hole.

* * * * *